United States Patent [19]

Lien

[11] 4,321,576

[45] Mar. 23, 1982

[54] FUSE HOLDER-UNDER OIL DRYWELL LOADBREAK DEVICE

[75] Inventor: Wayne W. Lien, Milwaukee, WI

[73] Assignee: RTE Corporation, Waukesha, Wis.

[21] Appl. No.: 134,967

[22] Filed: Mar. 28, 1980

[51] Int. Cl.[3] ..... H01H 85/38

[52] U.S. Cl. ..... 337/202; 337/211; 337/273

[58] Field of Search ..... 337/1, 202, 205, 207, 337/208, 209, 211, 213–215, 273, 274, 275, 278, 282, 186; 361/41

[56] References Cited

U.S. PATENT DOCUMENTS 3,628,092 12/1971 Keto ..... 337/202

3,699,490 10/1972 Macemon ..... 337/202

4,059,816 11/1977 Bonecutter et al. ..... 337/273

4,081,778 3/1978 Sack et al. ..... 337/205

*Primary Examiner*—William H. Beha, Jr.

[57] ABSTRACT

A drywell fuse holder and a loadbreak fuse assembly, the holder including an arc-extinguishing sleeve located adjacent to the inner contact sleeve, the loadbreak fuse assembly including a non-expulsion fuse having electrical interface assemblies at each end spaced apart a distance less than the distance the inlet to the contact sleeves in the fuse holder, the interface assemblies including a spacer ring to center the fuse assembly in the holder and protect the garter spring contact and an arcing washer to transfer the arc from the garter spring; and an arc-extinguishing follower on the fuse assembly which is pulled through the arc-extinguishing sleeve to extinguish the arc.

16 Claims, 3 Drawing Figures

FUSE HOLDER-UNDER OIL DRYWELL LOADBREAK DEVICE

BACKGROUND OF THE INVENTION

Drywell loadbreak fuse holders are commonly used to provide a sealed enclosure for a non-expulsion fuse assembly used in conjunction with oil-filled distribution transformers and switch modules. The fuse holder is generally mounted in the transformers to provide direct access to the fuse through the enclosure opening without opening the interior of the transformer to the atmosphere. The interior of the holder is sealed from both the atmosphere and from the fluids which are used to cool and insulate the transformer. In some instances, an electrical loadbreak device is provided with the non-expulsion fuse assembly.

SUMMARY OF THE INVENTION

The present invention is related to the combination of a drywell fuse holder and a fuse assembly. The fuse assembly includes a non-expulsion fuse which is provided with current interchange members each having an electrically conductive garter spring which provides a large number of electrical contact points, thus reducing the current carrying requirement of the individual contact points. This has been achieved by using a non-conductive centering spacer to maintain a balanced force on the garter spring while maintaining electrical communication between the garter spring contacts and the conductive sleeve in the fuse holder.

The garter spring also produces an angular airflow pattern during current interruption which spins the arc and thereby assists in cooling, quenching and ultimately clearing the circuit.

A new loadbreak mechanism is also provided which increases the efficiency of the arc extinguishing capability. This is achieved by increasing the diameter of the arc follower and arc quenching sleeve to a size substantially equal to the size of the fuse.

BRIEF DESCRIPTION OF DRAWING

For a better understanding of the invention, reference may be had to the following description taken in conjunction with the following drawings wherein.

DESCRIPTION OF THE PREFERRED EMBODIMENT

The present invention relates to the combination of a drywell fuse canister or holder 10 and a loadbreak fuse assembly 12. The drywell fuse holder 10 is shown mounted in an opening 14 in the wall 16 of an enclosure for an electrical apparatus. The loadbreak fuse assembly 12 is inserted into the fuse holder 10 in order to complete the circuit through the fuse holder to the electrical apparatus as is generally understood in the art.

Figure 2:
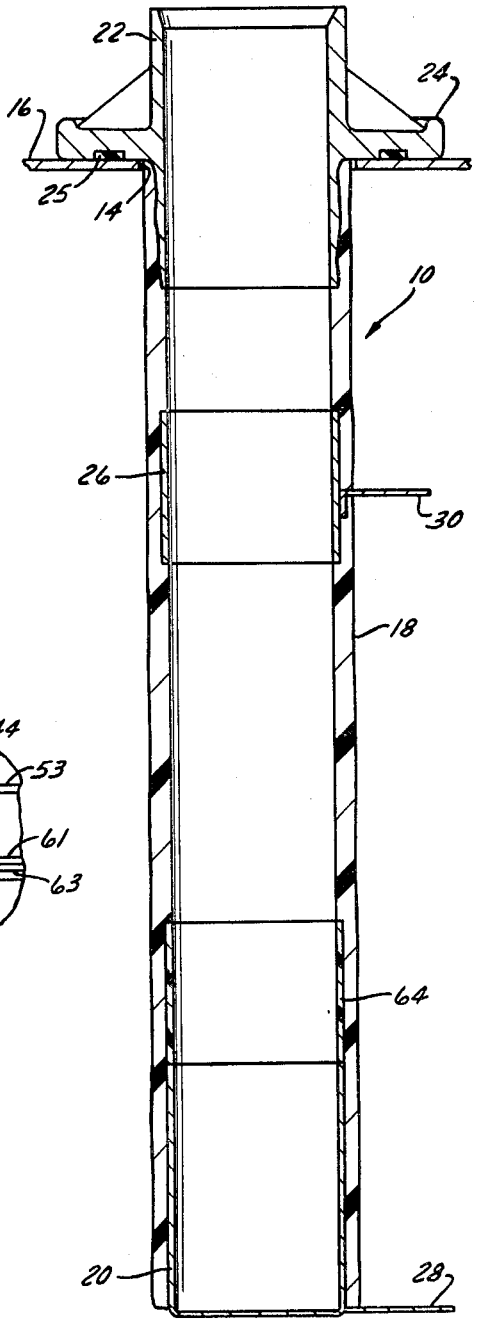
FIG. 2 is an elevation view in section of the fuse holder.

Referring to FIG. 2 of the drawings, the drywell fuse holder 10 includes a hollow dielectric tube 18 formed from an epoxy glass wound filament and is closed at one end by means of a conductive sleeve 20 and an open mounting tube 22 at the other end. The open mounting tube 22 is secured to the open end of the tube 18 and includes a mounting flange 24 which is used to secure the fuse holder 10 in the opening 14 in the wall of the enclosure. A gasket 25 can be provided in the mounting flange if desired to produce a seal to the enclosure wall 16. A second conductive sleeve 26 is provided intermediate to the ends of the tube 18 and is spaced from the first conductive sleeve 20 a predetermined distance as described hereinafter. Conductive leads 28 and 30 are connected to the conductive sleeves 20 and 26, respectively.

Figure 1:
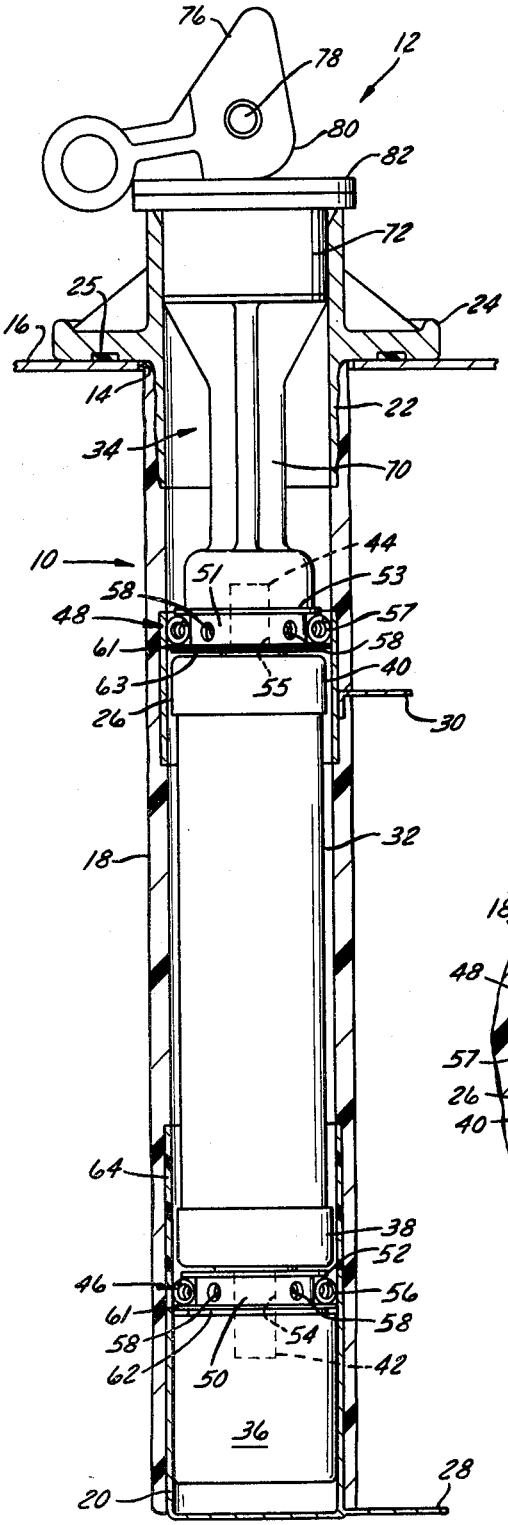
FIG. 1 is an elevation view partly in section showing the fuse assembly positioned in the fuse holder.

The loadbreak fuse assembly 12 as seen in FIG. 1 generally includes a current limiting fuse 32, a fuse puller assembly 34 and an arc extinguishing follower 36. The fuse includes electrically conductive contacts 38 and 40 at each end and contact posts 42 and 44 on the contacts 38 and 40, respectively.

Figure 3:
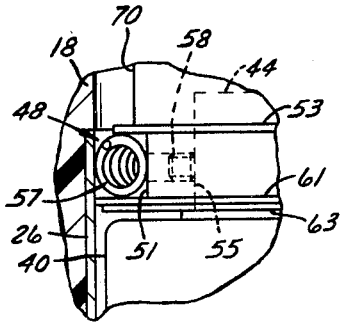
FIG. 3 is an enlarged view showing a portion of the electrical interface assembly.

The fuse contacts 38 and 40 are connected to the conductive sleeves 20 and 26 by means of electrically conductive current interface assemblies 46 and 48 mounted on the posts 42 and 44 located at each end of the current limiting fuse 32. The electrically conductive interface assemblies each include a hub 50, 51 having a flange 52, 53 on one side and a central opening 54, 55. FIG. 3 shows the interface assembly including hub 51 which is identical to the other assembly. Electrical connection between the hubs 50 and 51 and the conductive sleeves 20 and 26 is provided by means of garter springs 56, 57. The garter springs are mounted on the hubs and provide a plurality of electrical contact points around the periphery of the hub. The hub 50 at the inner or sealed end of the fuse holder 10 is mounted on the contact rod 42 with the flange 52 next to the contact 38. The hub 51, at the outer or open end of the fuse holder 10, is mounted on the contact post 44 with the hub 51 next to the contact 40 and the flange 53 remote therefrom. The hubs are secured in position by means of two cup-point slotted head set screws 58 which are tightened against the contact rods 42 and 44. The set screws 58 also provide electrical connection between the hubs 50, 51 and the corresponding posts 42 and 44 by forcing the post against the hub. It should be noted that the screws 58 are located under the garter spring 56, 57 which prevent the screws from falling out of the hub when loosened.

Means are provided on one side of each of the hubs 50, 51 for maintaining a space between the hub and the inner surface of the contacts 20 and 26 of the dielectric tube 18. Such means is in the form of flat spacer rings 60, 61 which are positioned on the contact rods 42 and 44 against the side of the hub opposite to the flanges 52, 53. The spacer rings have an outside diameter slightly less than the outside diameter of the garter springs 56, 57 and greater than the outside diameter of the fuse 32. The spacer rings 60, 61 act to center the interface assemblies 46 and 48 within the conductive sleeves 20 and 26 during momentary current surges. The magnetic forces resulting from momentary current surges can throw the fuse assembly to one side or the other of the fuse holder. The spacers act to protect the garter springs 56, 57 from collapsing as a result of movement of the fuse assembly from one side to the other of the fuse holder. Collapse of a garter spring could result in arcing and failure of the spring if an inadequate number of contacts results between the garter spring and the corresponding contact sleeve.

Means are provided adjacent to the spacer rings 60, 61 for transferring the arc on loadbreak or loadmake away from the garter springs 56, 57 to protect the garter spring from damage due to the arc. Such means is in the form of electrically conductive contact washers 62, 63 mounted on the rods 42 and 44 on the side facing the closed end of the fuse holder 10. The arcing washers also prevent contact welding from occurring during loadmake or loadbreak. As the fuse assembly is removed from the fuse holder 10, the arc is drawn out between the contact washers 62, 63 and the contact sleeves 20 and 26. The arc between contact sleeve 26 and the arc washer 63 will transfer to the contact 40 on the end of the current limiting fuse 32 if the arc is not extinguished by the time the fuse assembly has been pulled far enough to draw the arc from the washer 63 to the contact 40.

The arcing washers 62, 63 have a slightly smaller diameter than the spacer rings 60, 61. Any metal on the washers 62, 63 which becomes liquid due to the arc does not come in contact with the metal of the stationary contact sleeves 20 and 26. The possibility of a solid bridge forming across the gap between the washers 62, 63 and the sleeves 20, 26 is very slight.

In this regard, the arc is extinguished by means of the action of the arc follower 36 and an arc-extinguishing sleeve 64 provided in the tube 18. The arc-extinguishing sleeve 64 is formed from an arc quenching material such a Celcon or Delrin and is positioned in the dielectric tube 18 adjacent to the contact sleeve 20. The arc follower 36 is in the form of a solid cylinder also formed of an arc-extinguishing material, attached to the contact rod 42 on the end of the fuse 32 and has a diameter slightly smaller than the diameter of the sleeve 64. On removal of the fuse assembly from the fuse holder, the arc which has been transferred to the arcing washer 62, will be confined to the space between the arc follower 36 and the arc-quenching sleeve 64. The heat of the arc will generate a pressurized, ionized atmosphere in the space between the sleeve and the follower which will extinguish the arc.

It should be noted that the sleeve 64 and follower 36 are very large in diameter. The follower being larger than the fuse. This provides a substantially greater arc extinguishing surface area, approximately 400%, than present state of the art units. The increased surface area tends to increase the loadbreak life of the unit since the arc may strike to a new surface area of the circumference of the follower on each operation. In addition the arc follower, on removal from the holder 10, will pull a vacuum in the closed end of the fuse holder. Air drawn into the fuse holder by the vacuum will be drawn past the arc, cooling the arc and drawing any ionized gas into the closed end of the holder. The air, as it is drawn through the turns of the garter springs, will be directed at a slight angle creating an angular flow between the follower 36 and the sleeve 64. This flow will tend to spin the arc, lengthening the arc path which assists in cooling, quenching and ultimately clearing the arc.

The size of the spaces between the follower 36 and the sleeve 64 and the length of these members are critical since they control the arc-extinguishing factors listed above. The space between the follower 36 and the sleeve 64 must be less than 0.040" and the two parts must be longer than 1.0" in order to loadbreak the most difficult currents. The space between the sleeve 64 and follower 36 must be small enough so that the arc is forced to come close to the surface of one and preferably both of the arc-extinguishing members. The heat of the arc then causes arc-extinguishing gas to be generated by one or both of the arc-extinguishing members which helps to deionize the atmosphere after the arc extinguishes at current zero. The length of these members must be made sufficiently long to support and contain the pressure created by the arc. This pressure will permit the atmosphere in the space to withstand the voltage stress between the contact arc washer 63 and the conductive sleeve 20 until deionizing action is sufficient and the distance between the two members becomes large enough to prevent restrike.

In this design, the length of the follower 36 and the sleeve 20 is minimized by two factors, spinning of the air around the arc and introducing cool clean air into the arc. First, upon removal of the fuse assembly 12 a vacuum is created between the follower 36 and the conductive sleeve 20. This is due to the small space provided between the follower 36 and the bore of the tube 18. When the fuse assembly 12 is pulled out of the fuse holder 10 in a normal loadbreak fashion, a negative pressure is developed behind the follower 36. This negative pressure or vacuum draws the air through the garter spring 57 and the space around the fuse 32 into the space between the end of the follower 36 and the bottom of contact 20. As the air passes through the turns of the spring 57 it is redirected due to the pitch of the spring turns. This turbulent spinning of the air produces a corresponding spinning of the arc. This allows the follower 36 and sleeve 64 to be shorter since the effective distance over which the arc is extinguished is now the diagonal distance from the origin of the arc to the contact point of the arc.

The length of the parts can be further reduced because the air that the vacuum draws through the space between the follower 42 and the sleeve 61, as descried above, is relatively clean and cool compared to the air present in that space at the time the arc originates. This clean, cool air cools the arc area and sweeps the conductive arc products away from the arc thereby assisting the deionizing gas generated by the arc-extinguishing materials on the follower 36 and the sleeve 64 to extinguish the arc. The flow of cool clean air creates an atmosphere that will withstand the voltage stress between the contact arc washer 63 and the conductive sleeve 20 in less time than would be required if the air was not moving past the arc. This time may be as great as ½ to 1 arc cycles on a 200 amp 23 kv loadbreak.

The space between the follower 36 and the canister wall 18 must be great enough to allow the air to pass the follower 36 and reduce the negative pressure to a point where a person of average strength can withdraw the fuse assembly with the normal average loadbreak speed of 60" per second. The minimum difference between the OD of the follower 36 and the ID of the fuse holder tube 18 on a 2½" unit is 0.015".

It should be noted that the spacing between the ends of the sleeves 20 and 26, facing the open end of the fuse holder assembly, is such that the arc washer 62 on the interface assembly 46 will clear the end of the sleeve 20 prior to the time that the garter spring 57 on the interface assembly 48 clears the end of the sleeve 26. The arc will thus be drawn across the gap between the washer 62 and the sleeve 20 prior to the time that the spring 57 clears the end of the contact 26. It should be apparent that if the arc between the contact sleeve 20 and the corresponding arcing washer 62 is extinguished prior to the time that the spring 57 clears the sleeve 26 no arcing will occur between the washer 63 and the sleeve 26.

The fuse pulling assembly 34, which is provided at the end of the current limiting fuse 32, includes a connecting member 70 which is secured to the contact post 44 and is formed from non-conducting material. A compressible seal 72 is provided at the end of the member 70 which is compressed after assembly to expand in the open end of the mounting tube 22 to seal the fuse within the canister. The ring 72 is compressed by means of a cam 76 pivotally mounted on a rod 78 conncted to the member 70 and having a cam surface 80 which bears against a washer 82. On rotation of the cam about the pin, the washer 70 will be pushed down slightly squeezing the seal 72 against the member 70 so that it expands and seals the fuse assembly within the holder 10.

The embodiments of the invention in which an exclusive property and privilege is claimed are defined as follows:

1. The combination of a drywell fuse holder and a loadbreak fuse assembly;

said fuse holder including a dielectric housing, first electrical contact means mounted on the inside surface of the housing at the inner end of the housing, second electrical contact means in said housing spaced outwardly from said first contact means, first arc-extinguishing means mounted on the inside surface of said housing adjacent to said first contact means;

said fuse assembly including a non-expulsion fuse electrical interface means at each end of said fuse for connecting said fuse to said first and second contact means, second arc-extinguishing means at the inner end of said fuse assembly, and fuse pulling means connected to the outer end of said fuse for pulling said fuse assembly from said fuse holder whereby said second arc extinguishing means is pulled through said first arc-extinguishing means to extinguish the arc between the fuse and the first contact means.

2. The combination according to claim 1, wherein said second arc-extinguishing means comprises a cylindrical member formed from an arc-extinguishing material and having an outer diameter greater than the outer diameter of said fuse.

3. The combination according to claim 1 or 2, wherein each of said interface means includes a hub and a garter spring having an outside chamber greater than the inside diameter of the contact means, the spring being mounted on said hub to provide electrical communication between said hub and said first and second contact means.

4. The combination according to claim 3, wherein each of said interface means includes a dielectric spacer ring having an outer diameter slightly less than the garter spring in the assembled condition.

5. The combination according to claim 4, wherein each of said interface means includes an arcing washer position adjacent to said dielectric ring on the side remote from said garter spring.

6. The combination according to claim 5, wherein said arcing washer has an outside diameter smaller than the diameter of said dielectric spacer ring.

7. The combination of a drywell fuse holder and a loadbreak fuse assembly, said fuse holder including a dielectric tube having first and second contact sleeves mounted therein at a predetermined spaced distance apart, an arc-extinguishing sleeve mounted in said tube in the space between the contact sleeves and adjacent to said first contact sleeve;

said fuse assembly including a non-expulsion fuse, an electrical interface means mounted on each end of said fuse, said interface means being spaced apart a distance less than the distance between the inlet ends of said contact sleeves, and an arc extinguishing follower attached to the remote end of said fuse whereby said arc extinguishing follower enters the arc extinguishing sleeve when the remote interface means clears said first contact sleeve to confine the arc to the space between the arc follower and the arc quenching sleeve.

8. The combination according to claim 7, wherein the arc follower has a diameter as great or greater than the diameter of the fuse.

9. The combination according to claim 7 or 8, wherein each of said electrical interface means includes a spacer ring formed of an insulating material and having a diameter greater than the fuse and less than the diameter of the contact sleeve.

10. The combination according to claim 9, wherein said electrical interface means includes a garter spring on one side of said spacer ring and an arcing ring on the other side of said spacer ring, said garter spring having a diameter greater than the spacer ring and the arcing ring having a diameter smaller than the spacer ring.

11. The combination of a drywell loadbreak fuse assembly and fuse holder, said loadbreak fuse holder including a hollow dielectric tube, a first conductive sleeve mounted on one end of the dielectric tube, a conductive lead connected to said first conductive sleeve, a second conductive sleeve mounted on the inside of the dielectric tube in a spaced relation to said first conductive sleeve, a second conductive lead connected to said second conductive sleeve, a sleeve of arc-extinguishing material mounted on the inside surface of said dielectric tube adjacent to said first conductive sleeve and spaced from said second conductive sleeve and said loadbreak fuse assembly including a non-expulsion fuse having an electrically conductive interface means connected to each end of said fuse for electrically connecting said fuse to said first and second conductive sleeves, each of said interface means including a contact hub connected to said fuse, an electrically conductive garter spring mounted on the outside surface of said hub and having an outside diameter slightly larger than the inside diameter of said first and second conductive sleeves, a non-conductive spacer ring mounted on said hub and having an outside diameter smaller than said garter spring and greater than said fuse, an electrically conductive arcing ring mounted on said hub and having a diameter smaller than the diameter of said spacer ring and an arc-extinguishing follower mounted on the end of said fuse assembly and having a diameter as great or greater than the diameter of the fuse, whereby on removal of said fuse assembly from said dielectric tube the arc between said arcing ring and said first conductive sleeve is confined to the space between said arc extinguishing follower and said arc extinguishing sleeve, the heat of the arc producing an ionized atmosphere to extinguish the arc.

12. The combination according to claim 11, wherein said garter springs are spaced a distance apart less than the distance between the inlet ends of said contact sleeves.

13. The combination according to claim 11, wherein said first conductive sleeve is closed at the end and said arc follower on assembly is located in close proximity to the closed end of the sleeve, whereby on removal of the fuse assembly from the fuse holder a supportive negative pressure is developed in the space between the arc follower and the closed end of the sleeve, which acts to draw air from the open end of the fuse holder through the space where the loadbreak arcing occurs and into the space of negative pressure to assist in cooling the arc and flushing out the space between said arc extinguishing follower and said arc extinguishing sleeve.

14. The combination according to claim 13, whereby means is provided to cause the air traveling through the space between the follower and sleeve to swirl, whereby the length of the arc is extended.

15. The combination according to claim 13, wherein the pitch of the turns of the garter spring directs the air drawn through the space between the arc follower and arc-extinguishing sleeve to swirl in a uniform direction to lengthen and therefore cool the arc.

16. The combination according to claim 11, 12, or 13, wherein the space between the arc follower and the arc-extinguishing sleeve is selected to control the speed at which the fuse assembly may be withdrawn from the holder.

* * * * *